US010928760B2

(12) United States Patent
Kawasaki et al.

(10) Patent No.: US 10,928,760 B2
(45) Date of Patent: Feb. 23, 2021

(54) IMAGE FORMING APPARATUS

(71) Applicant: CANON KABUSHIKI KAISHA, Tokyo (JP)

(72) Inventors: Yasuhiro Kawasaki, Yokohama (JP); Chitose Tempaku, Numazu (JP); Yuki Nishizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/238,225

(22) Filed: Jan. 2, 2019

(65) Prior Publication Data

US 2019/0212682 A1 Jul. 11, 2019

(30) Foreign Application Priority Data

Jan. 10, 2018 (JP) ..... JP2018-001605

(51) Int. Cl.

| | |
|---|---|
| ***G03G 15/20*** | (2006.01) |
| ***G03G 15/00*** | (2006.01) |
| ***G03G 15/06*** | (2006.01) |
| ***G03G 15/16*** | (2006.01) |
| ***G03G 21/20*** | (2006.01) |

(52) U.S. Cl.

CPC ..... *G03G 15/2053* (2013.01); *G03G 15/065* (2013.01); *G03G 15/16* (2013.01); *G03G 15/2017* (2013.01); *G03G 15/6558* (2013.01); *G03G 21/206* (2013.01)

(58) Field of Classification Search

USPC ..... 399/320

See application file for complete search history.

(56) References Cited

U.S. PATENT DOCUMENTS 6,254,221 B1 * 7/2001 Bard ..... G03G 15/348 347/55

9,223,290 B2 12/2015 Aiba et al.

(Continued)

FOREIGN PATENT DOCUMENTS

JP 2002-365986 A 12/2002

JP 2005-257768 A 9/2005

(Continued)

OTHER PUBLICATIONS

Computer translation of JP2010-002803A, published Jan. 7, 2010, This JP reference is cited by applicant. (Year: 2010).*

(Continued)

*Primary Examiner* — Quana Grainger

(74) *Attorney, Agent, or Firm* — Venable LLP

(57) ABSTRACT

An image forming apparatus includes an image forming portion configured to form a toner image on a recording material; a fixing portion configured to fix the toner image on the recording material by heating the toner image formed on the recording material; a flow path including a first space connecting with the fixing portion and a second space connecting with the first space and through which air discharged from the fixing portion passes; a first electrode portion provided in the first space and provided with a first potential; and a second electrode portion provided in the second space and provided with a second potential different from the first potential. An air speed of the air passing through the second space is slower than an air speed of the air passing through the first space.

24 Claims, 8 Drawing Sheets

(56) References Cited

U.S. PATENT DOCUMENTS

| | | | | |
|---|---|---|---|---|
| 2002/0025174 | A1* | 2/2002 | Sakurai | G03G 21/1814 399/13 |
| 2008/0124138 | A1* | 5/2008 | Kosugi | G03G 15/0818 399/285 |
| 2011/0211860 | A1 | 9/2011 | Shimoyama et al. | |
| 2013/0243471 | A1 | 9/2013 | Ikeda et al. | |
| 2017/0205765 | A1 | 7/2017 | Mikami | |
| 2018/0032011 | A1* | 2/2018 | Nanjo | G03G 15/2064 |

FOREIGN PATENT DOCUMENTS

| | | | | |
|---|---|---|---|---|
| JP | 2010-002803 | A | | 1/2010 |
| JP | 2015175873 | A | * | 10/2015 |
| JP | 2015-191156 | A | | 11/2015 |
| JP | 2017-015802 | A | | 1/2017 |

OTHER PUBLICATIONS

Cited above at N: JP2015-175873A; Oct. 2015; no drawing figures were available (Year: 2015).*
Extended European Search Report dated May 15, 2019, in European Patent Application No. 19150297.0.

* cited by examiner (a)

(b)

(a)

(b)

COMPARISON EXAMPLE (a)

(b)

(a)

(b)

IMAGE FORMING APPARATUS

FIELD OF THE INVENTION AND RELATED ART

The present invention relates to an image forming apparatus.

In an image forming apparatus, such as a copying machine, a printer or a facsimile machine, of an electrophotographic type or the like, a fixing device (fixing portion) for fixing an unfixed toner image, formed on a recording material, on the recording material by high-temperature heating is provided. By this high-temperature heating in the fixing device, a volatile substance is created from a parting wax principally contained in toner and is suspended and scattered around in some instances.

In recent years, with raised awareness of environmental (ecological) problems, it is desired that generation of ultrafine particles (UFPs) also be suppressed. The term UFP refers to particles of not more than 100 nm in diameter of a suspended particulate matter (SPM) in general. In the "Blue Angel," which is a standard of a so-called eco-label issued to environmentally friendly products in the Federal Republic of Germany, UFPs are defined as particles of 7 nm-300 nm in diameter.

As a technique for reducing discharge (emission) of UFPs, Japanese Laid-Open Patent Application (JP-A) 2015-191156 discloses a technique such that an accumulating space other than a feeding space is provided downstream of a fixing nip with respect to a feeding direction of the recording material. Further, JP-A 2010-2803 discloses a technique in which an electrostatic collecting means for electrostatically collecting UFPs is provided.

Further, it has been known that fine particles of 1-20 μm in diameter can be collected with high efficiency by the electrostatic collecting technique, but the collecting efficiency for sub-micron particles of less than 1 μm in particle size is lower (Static Electricity Handbook (JSBN4-27403510-7), Ohmsha, Ltd.). The reason is that is becomes difficult to move the particles by electrostatic force since the electrostatic force acting on the sub-micron particles is small and the influence of viscosity resistance of gas becomes large.

In the future, there is a liability that a printing speed is improved with improvement in productivity of the image forming apparatus and thus an amount of discharge per unit toner image of UFPs increases. Accordingly, a collecting technique with high collecting efficiency for UFPs has been required.

A constitution in which UFPs are collected by accumulating the generated UFPs and by absorbing the UFPs on a surface forming the accumulating space has been proposed (JP-A 2015-191156). This collecting technique uses a phenomenon such that when the UFPs contact a high-temperature portion, the UFPs are liquefied and then deposited and, therefore, there is a need to increase a temperature of a wall on which the UFPs are to be deposited. That is, the UFPs cannot be collected until the temperature of the surface (wall) reaches a predetermined temperature. Accordingly, when further improvement in productivity of the image forming apparatus is taken into consideration, in this collecting technique, further improvement has been required in order to improve the collecting efficiency particularly at the toner image fixation section of the image forming apparatus.

On the other hand, in an image forming apparatus disclosed in JP-A 2010-2803, a constitution in which the UFPs are collected using the electrostatic collecting technique has been proposed. The electrostatic collecting technique is a technique such that the UFPs are actively collected by imparting the electrostatic force to the UFPs. However, as described in the Static Electricity Handbook, there is a tendency that the collecting efficiency for the sub-micron particles of less than 1 μm in particle size lowers. Accordingly, in this electrostatic collecting technique, further improvement has been required in order to improve the collecting efficiency for the sub-micron particles of less than 1 μm in particle size.

Incidentally, in order to enhance the collecting efficiency of the electrostatic collecting technique, a technique such that a particle size of the UFPs is increased using an UFP agglomerating means (cyclone collecting means) before the UFPs pass through the electrostatic collecting means is also disclosed. The UFP agglomerating means (cyclone collecting means) is a technique (means) such that the UFPs are guided into a space (UFP agglomerating space) in which a high-speed eddy is generated and the UFPs are agglomerated using centrifugal force. However, the UFP agglomerating means (cyclone collecting means) needs both a fan for generating the high-speed eddy and the UFP agglomerating space, and therefore, there arise problems such as an increase in cost and upsizing of the collecting device (means).

SUMMARY OF THE INVENTION

A principal object of the present invention is to provide an image forming apparatus capable of meeting improvement in productivity of the image forming apparatus by efficiently collecting ultra-fine particles generating in the image forming apparatus while employing a simple apparatus (device) constitution.

According to an aspect of the present invention, there is provided an image forming apparatus comprising an image forming portion configured to form a toner image on a recording material; a fixing portion configured to fix the toner image on the recording material by heating the toner image formed on the recording material; a flow path including a first space connecting with the fixing portion and a second space connecting with the first space and through which air discharged from the fixing portion passes; a first electrode portion provided in the first space and provided with a first potential; and a second electrode portion provided in the second space and provided with a second potential different from the first potential, wherein an air speed of the air passing through the second space is slower than an air speed of the air passing through the first space.

According to another aspect of the present invention, there is provided an image forming apparatus comprising an image forming portion configured to form a toner image on a recording material; a fixing portion configured to fix the toner image on the recording material by heating the toner image formed on the recording material; a flow path including a first space connecting with the fixing portion and a second space connecting with the first space and through which air discharged from the fixing portion passes; a first electrode portion provided in the first space and provided with a first potential; and a second electrode portion provided in the second space and provided with a second potential different from the first potential, wherein a cross-sectional area of the second space with respect to a direction perpendicular to a direction of the air entering the second space is larger than a cross-sectional area of the first space with respect to a direction perpendicular to a direction of the air entering the first space.

Further features of the present invention will become apparent from the following description of exemplary embodiments with reference to the attached drawings.

Figure 3:
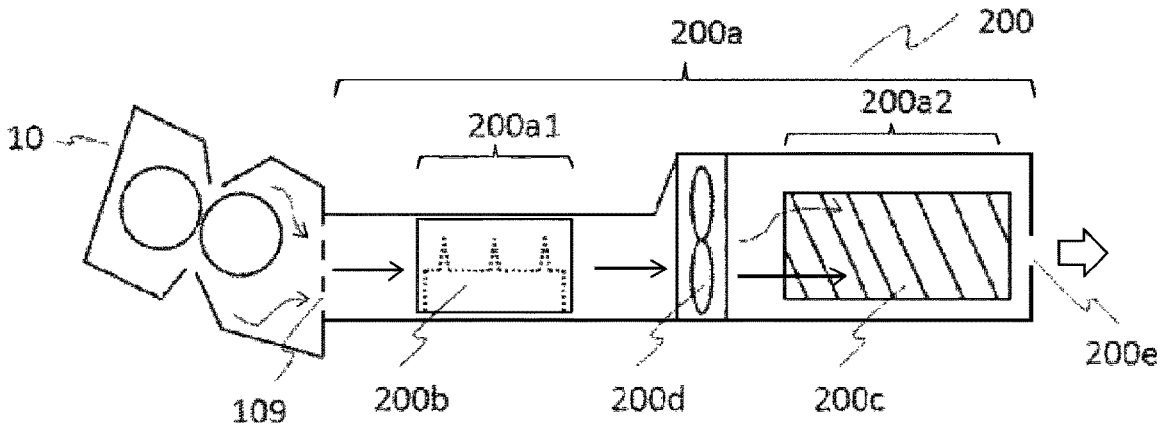
Figure 3:
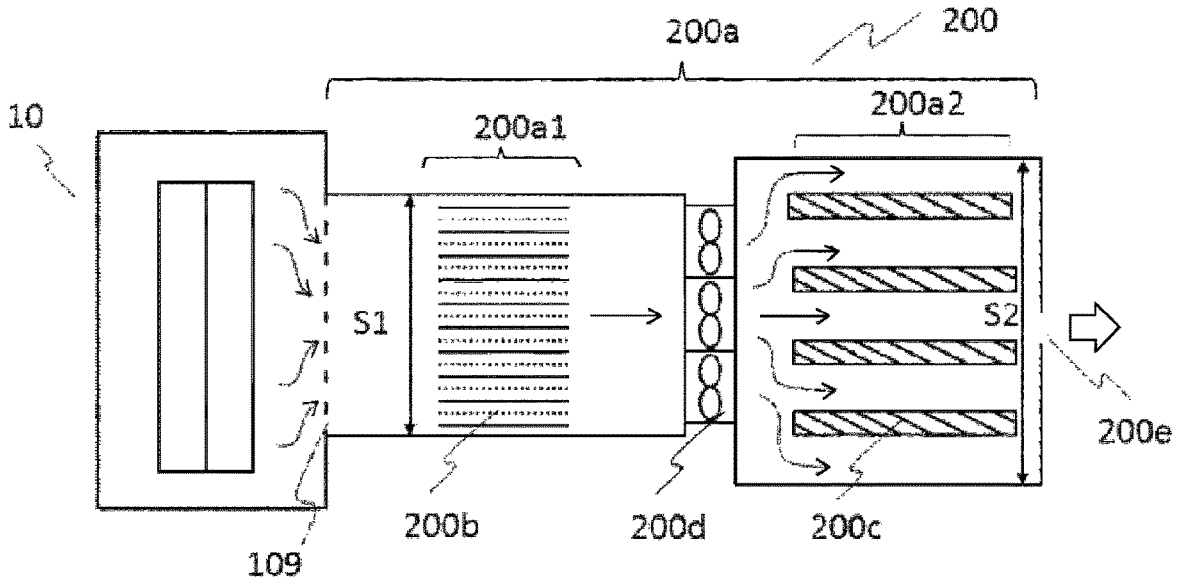

Part (a) of FIG. 3 is a longitudinal sectional view of a fixing device and a UFP collecting means in a First Embodiment, and part (b) of FIG. 3 is a top view of the fixing device and the UFP collecting means in the First Embodiment.

Figure 4:
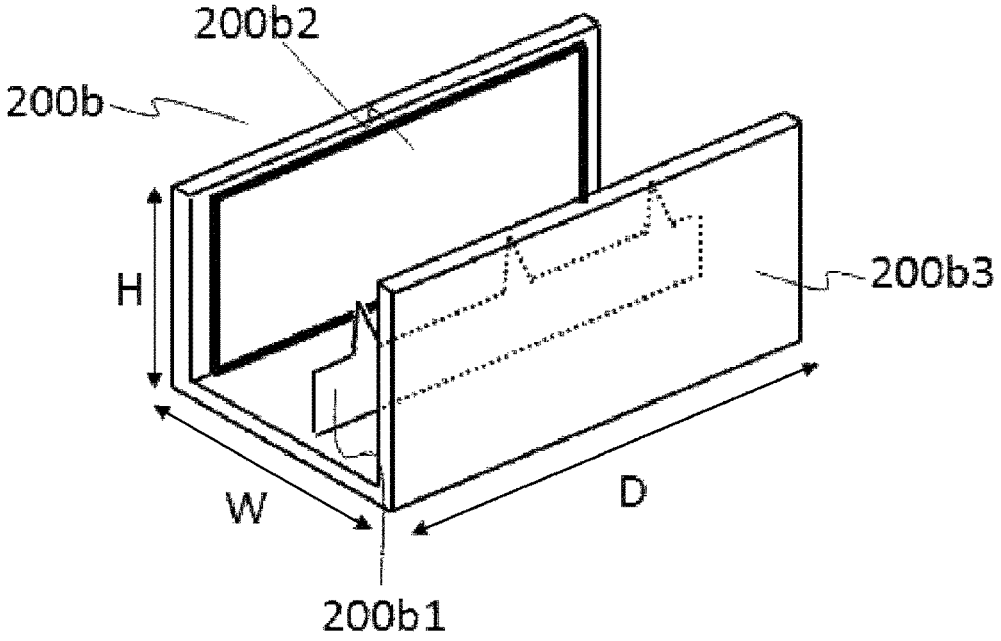

FIG. 4 is a perspective view of a charging means 200*b*.

Figure 5:
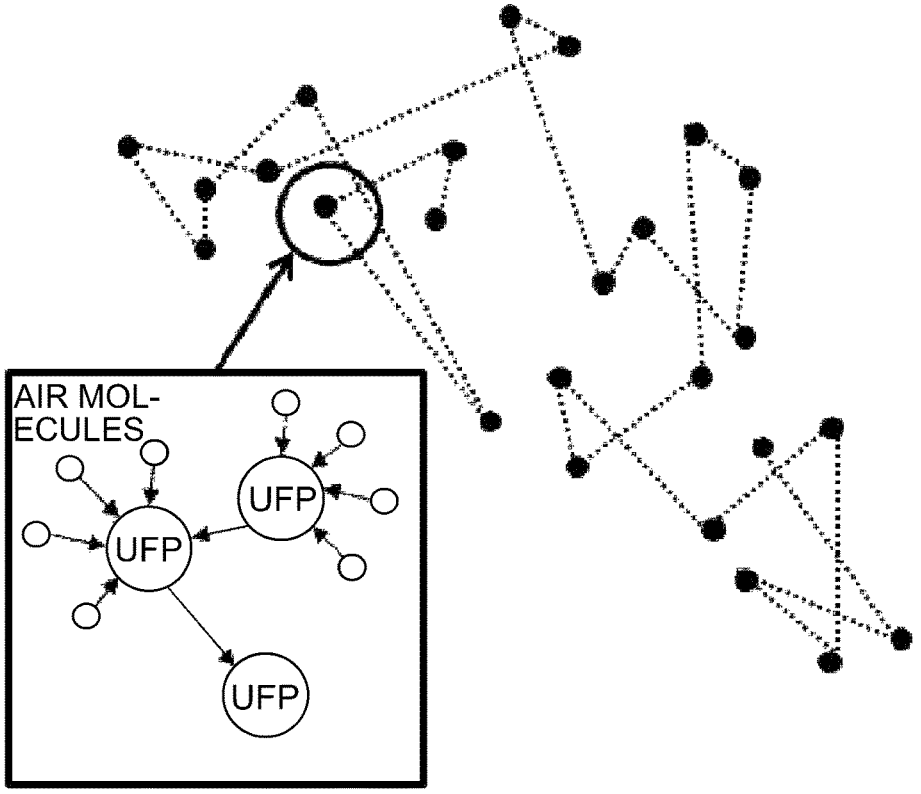

FIG. 5 is a schematic view of Brownian diffusion movement.

Figure 6:
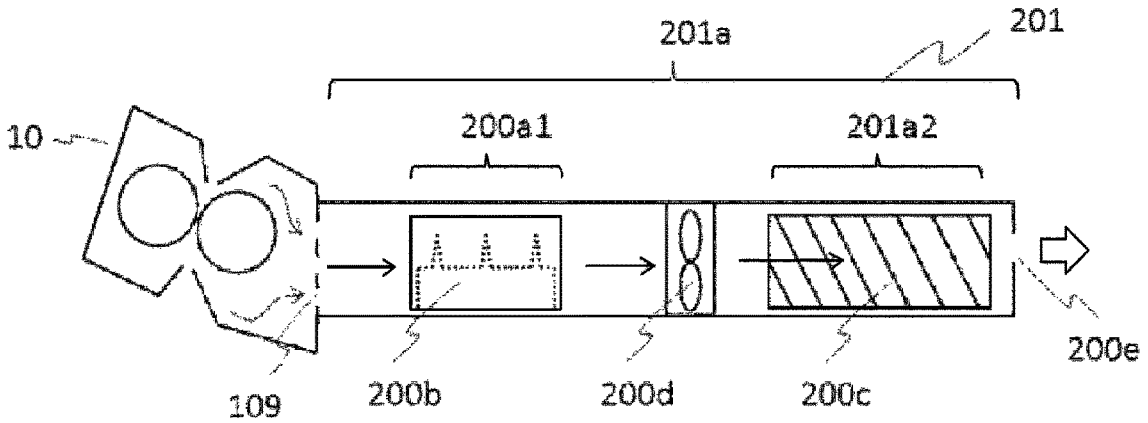
Figure 6:
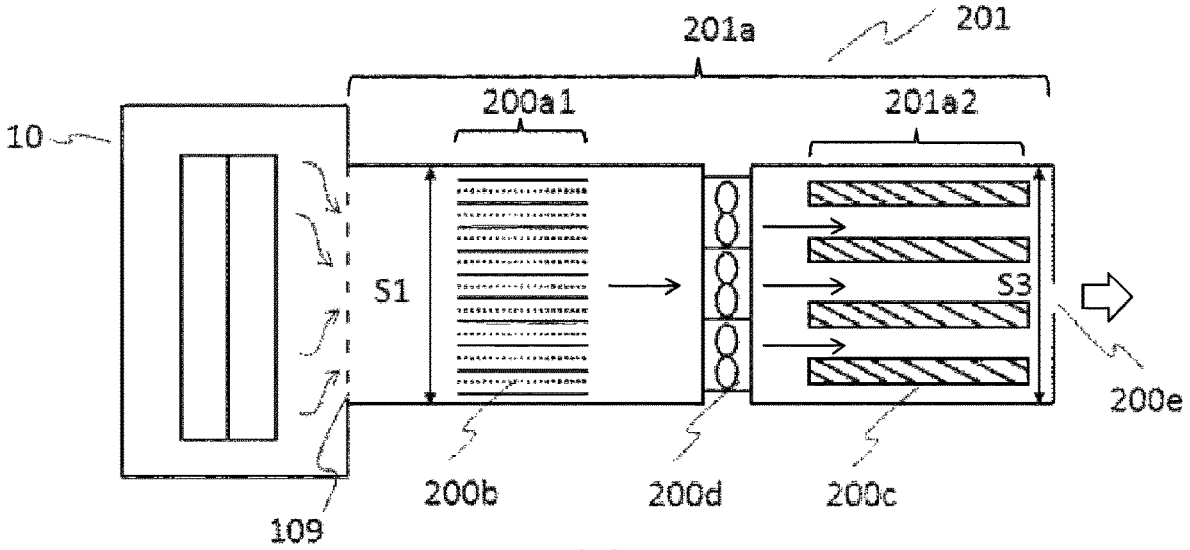

Part (a) of FIG. 6 is a longitudinal sectional view of a fixing device and a UFP collecting means in the First Embodiment, and part (b) of FIG. 6 is a top view of the fixing device and the UFP collecting means in Comparison Example 2.

Figure 7:
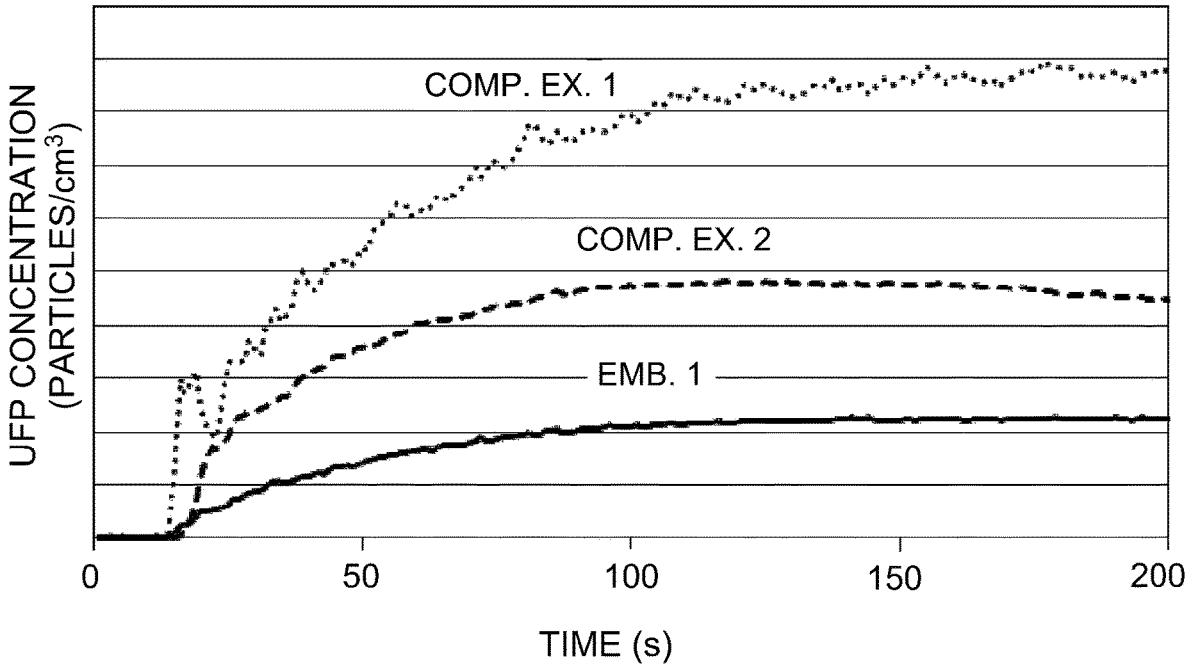

FIG. 7 is a graph for illustrating a result of an effect confirmatory experiment of the First Embodiment.

Figure 8:
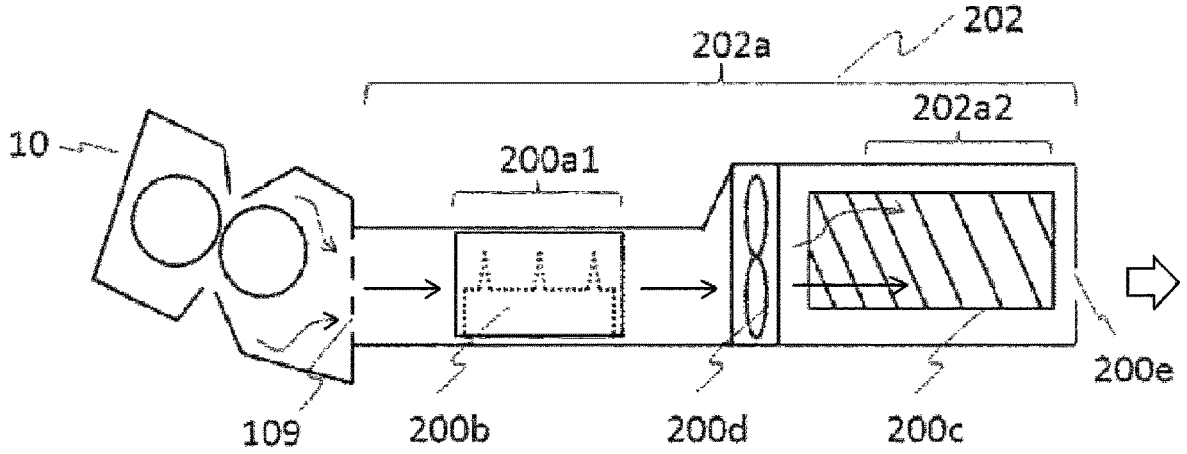
Figure 8:
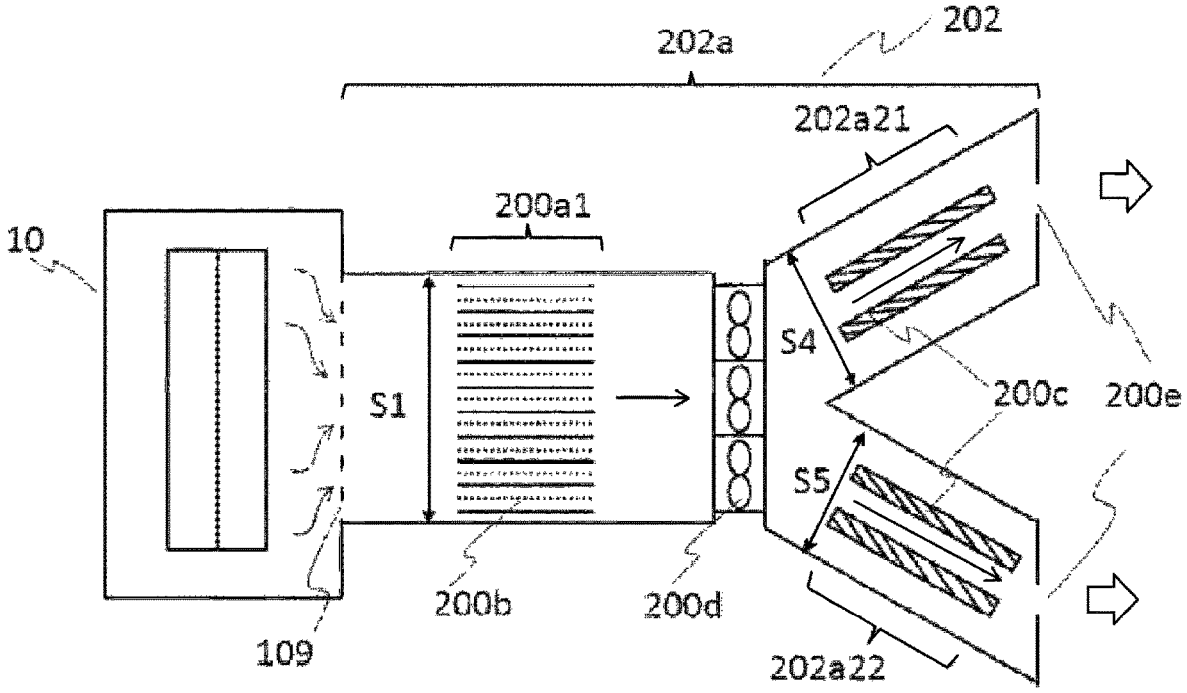

Part (a) of FIG. 8 is a longitudinal sectional view of a fixing device and a UFP collecting means in a Second Embodiment, and part (b) of FIG. 8 is a top view of the fixing device and the UFP collecting means in the Second Embodiment.

Figure 9:
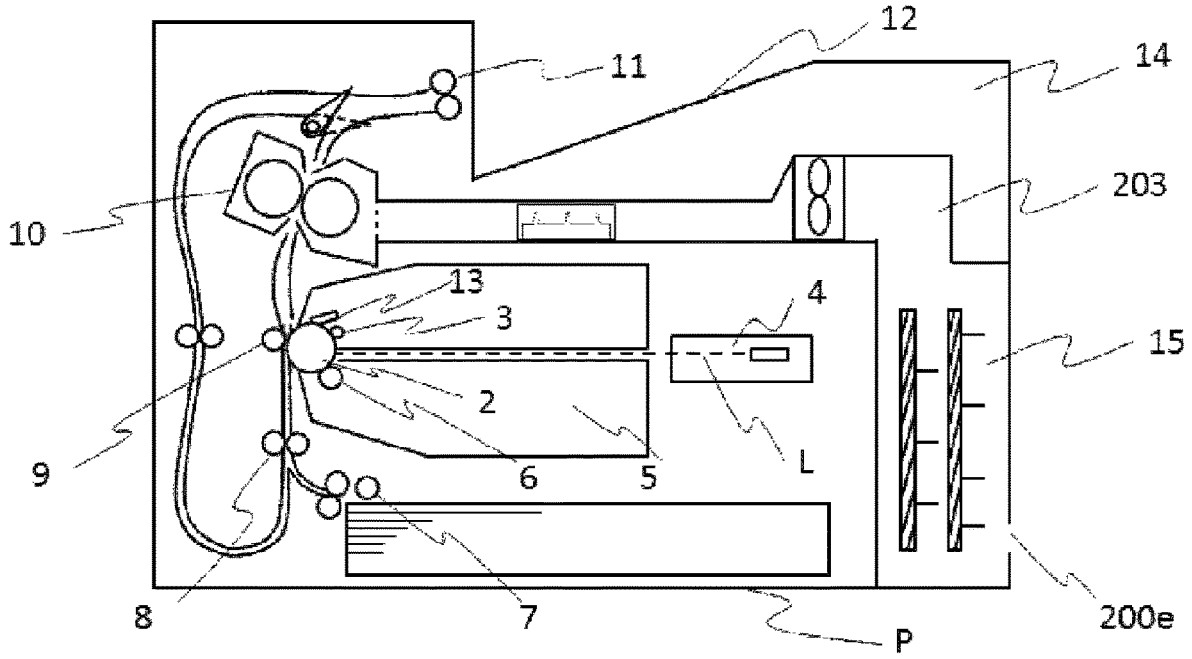

FIG. 9 is a longitudinal sectional view of a main assembly of an image forming apparatus in a Third Embodiment.

Figure 10:
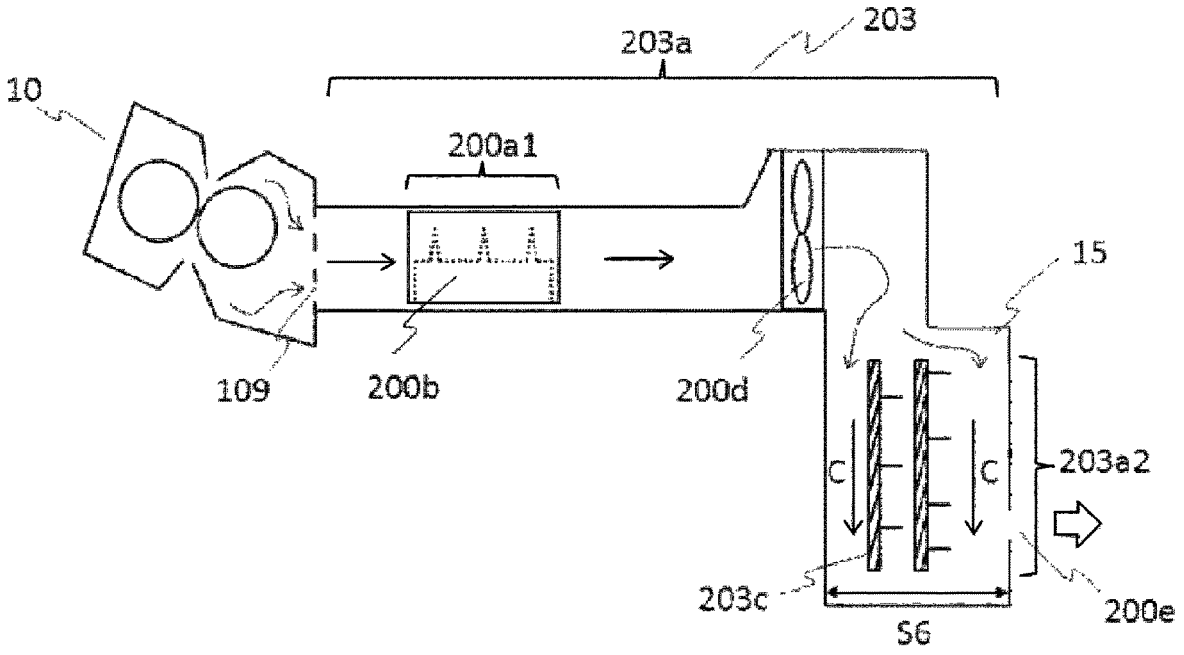
Figure 10:
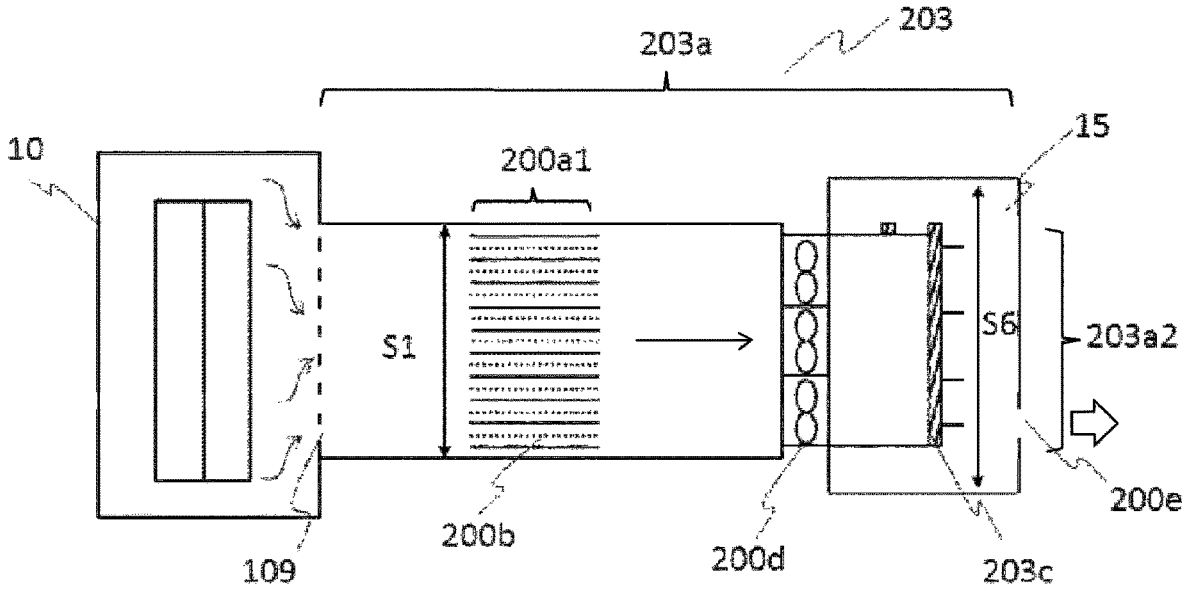

Part (a) of FIG. 10 is a longitudinal sectional view of a fixing device and a UFP collecting means in the Third Embodiment, and part (b) of FIG. 10 is a top view of the fixing device and the UFP collecting means in the Third Embodiment.

DESCRIPTION OF EMBODIMENTS

Embodiments of the present invention will be described specifically with reference to the drawings.

First Embodiment (Image Forming Apparatus)

Figure 1:
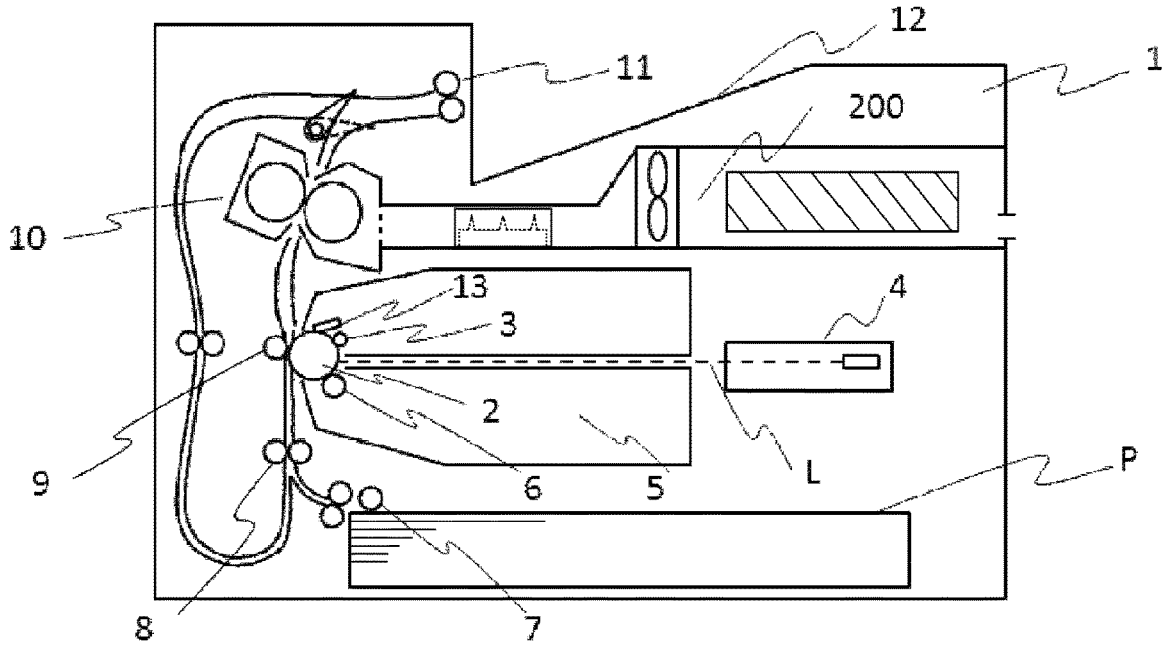
FIG. 1 is a longitudinal sectional view of a main assembly of an image forming apparatus according to an embodiment of the present invention.

FIG. 1 is a schematic sectional view of an image forming apparatus according to a First Embodiment of the present invention. Incidentally, the present invention is not limited thereto, but may also be widely applicable to image forming apparatuses of other types.

An image forming apparatus 1 is a laser beam printer using an electrophotographic process. A photosensitive drum 2 as an image bearing member is rotationally driven at a predetermined peripheral speed and is electrically charged to a predetermined polarity and a predetermined potential by a charging roller 3. A laser beam scanner 4 as an exposure means outputs laser light L modulated depending on image information sent from a CPU and subjects the drum 2 to scanning exposure. By this scanning exposure, an electrostatic latent image is formed. A developing device includes a developing roller 6 from which toner is supplied to a surface of the drum 2, so that the electrostatic latent image is developed into a toner image.

On the basis of a sheet (paper) feeding start signal, a sheet feeding roller 7 is driven, so that sheets of recording material (recording paper) P are separated and fed one by one. The recording material P passes through a registration roller pair 8 and is guided through the registration roller pair 8 into a transfer nip, at predetermined timing, formed by the drum 2 and a transfer roller 9. The transfer roller 9 transfers the toner image from the surface of the drum 2 onto a surface of the recording material P under application of a transfer bias voltage of a polarity opposite to a charge polarity of the toner. Thereafter, the recording material P is subjected to a fixing process of the toner image by a fixing device (fixing portion) 10 and is fed to a sheet discharging roller pair 11, and then is discharged onto a sheet discharge tray 12.

On the other hand, the surface of the drum 2 is cleaned by bringing a cleaning device 13 provided with a cleaning blade into contact with the drum 2 so that a free end of the cleaning blade is oriented toward an upstream side of a rotational direction of the drum 2 (counter contact), and then is repetitively subjected to an image forming operation. In the image forming apparatus 1, a UFP collecting means 20 for collecting UFPs (ultra-fine particles) of less than 100 nm in particle size generated in the fixing device 10 is provided. The UFP collecting means 200 for forming a flow path forming portion described specifically later is disposed with respect to a direction crossing a feeding direction of the recording material in the fixing device 10.

(Fixing Device)

Figure 2:
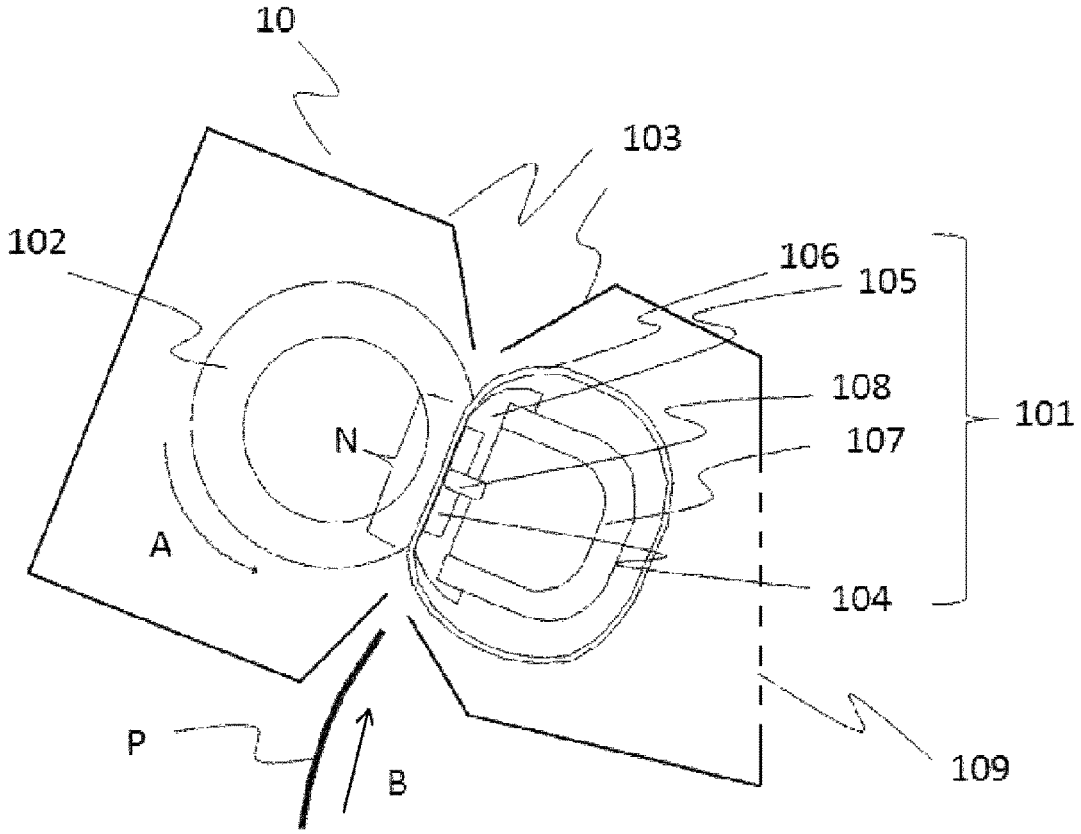
FIG. 2 is a detailed sectional view of a fixing device in the embodiment.

In the following, a detailed structure of the fixing device 10 will be described with reference to FIG. 2. In the fixing device 10, a heating unit 101 and a rotatable pressing member 102 are provided and accommodated in a casing 103.

The heating unit 101 includes a heater 104 as a heating means. This heater 104 is supported by a heater holder 105 as a supported member. A sleeve-like fixing sleeve (fixing film) 106 as a rotatable heating member is fitted around the heater holder 105. For this reason, the heater holder 105 is formed of a heat-resistant resin material such as a liquid crystal polymer or the like having a heat-resistant property and a sliding property so as to guide the fixing sleeve 106. The fixing sleeve 106 includes a base layer made of metal such as SUS which resists thermal and mechanical stresses and which has a good thermal conductivity. On the base layer, a PFA (perfluoroalkoxy) resin material is applied in a layer, and ensures a parting property for ensuring a separation performance.

The pressing roller 102 includes a core metal, an elastic layer formed with a silicone rubber or the like, and a surface layer coated on the elastic layer with the PFA resin material excellent in parting property similarly as in the case of the fixing sleeve. A metal stay 107 presses the heater holder 105 and the heater 104 toward the pressing roller 102 through the fixing sleeve 106, so that a fixing nip N is formed. The heater 104 is heated by energization by subjecting an unshown energizing means to on-off control. A thermistor 108 as a temperature detecting means contacts the heater 104, and on the basis of a detection temperature thereof, the heater 104 is temperature-controlled to a predetermined target set temperature.

The set temperature in this embodiment is 180° C. In this state, when the pressing roller 102 is rotated in an arrow A direction, the fixing sleeve 106 receives a frictional force of an outer peripheral surface thereof at the nip N, and the frictional force of the outer peripheral surface overcomes a frictional force of an inner peripheral surface thereof, so that the fixing sleeve 106 is rotated by the pressing roller 106. The recording material P on which the unfixed toner image is carried is guided into the nip N in a feeding direction (arrow B direction), and then is nipped and fed through the nip N. In this feeding process, heat of the heater 104 is imparted to the recording material P through the fixing sleeve 106, so that the toner image is fixed on the recording material P.

(UFP Generating Mechanism)

The toner contains a hydrocarbon parting wax such as paraffin wax, polyethylene wax or polypropylene wax. The parting wax bleeds from an inside of the toner when the toner is deformed (crushed) by heat and pressure of the fixing nip N. A melting point of the parting wax is set at 76° C., for example, and when a temperature of the parting wax becomes the melting point or more, the parting wax is melted and enters a boundary between the toner and the surface of the fixing sleeve 106. The melted parting wax prevents the melted toner from depositing and remaining on the fixing sleeve 106.

A part of this parting wax does not remain in a liquid state, but is vaporized and moves while riding an air flow in a casing 103. The parting wax which has been vaporized condenses again and becomes the UFPs of less than 0.1 nm in particle size.

(UFP Collecting Means)

1) UFP Collecting Means Air Flow

The image forming apparatus 1 shown in FIG. 1 includes a UFP collecting means 200. As shown in FIG. 2, the casing 103 is provided with an opening 109 at a surface opposing the fixing sleeve 106. The size of the opening 109 is 20 mm×220 mm. By providing the opening 109, the UFPs generated in the fixing device 10 can be guided to the UFP collecting means 200. When the substrate of the opening 109 is such that a width (220 mm) with respect to a longitudinal direction is equal to or more than a length of a printing region, the UFPs can be efficiently guided. Here, the longitudinal direction is a direction perpendicular to the recording material feeding direction. In this embodiment, a constitution in which a lattice-like plate material is provided in the opening 109 was employed. The lattice-like plate material has a mesh sufficiently larger than the UFP and is 50% or more in aperture ratio.

Part (a) of FIG. 3 is a longitudinal sectional view of the fixing device 10 and the UFP collecting means 200 and part (b) of FIG. 3 is a top view of the fixing device 10 and the UFP collecting means 200. The UFP collecting means 200 is constituted by a suction opening in the neighborhood of the fixing device 10, an exhaust opening 200*e* leading to an outside of the image forming apparatus 100, an exhaust duct (flow path forming portion) 200*a* ranging from the suction opening to the exhaust opening 200*e*, a charging means 200*b*, collecting electrodes 200*c* and a fan 200*d* for discharging the air.

When the fan 200*d* is rotated, the UFPs generated in the fixing device 10 pass through the opening 109 and are guided in an arrow direction in the exhaust duct 200*a* through the suction opening. The air containing the guided UFPs passes through a charging space (first space) 200*a*1 in which the charging means 200*c* is disposed. Then, the air passes through a collecting space (second space) 200*a*2, in which the collecting electrodes 200*c* are disposed, and is discharged (exhausted) to the outside of the apparatus. Thus, the flow path forming portion prepared by forming the charging space 200*a*1 and the collecting space 200*a*2, through which the air discharged from the fixing device 10 is successively passed, is formed.

In this embodiment, the exhaust duct 200*a* is entirely formed of a resin material, and the suction opening is disposed in the neighborhood of the lattice-like opening 109 of the fixing device 10 and has a cross-section of 25 mm×230 mm. A size S1 of a cross-section of the charging space 200*a*1 with respect to a traveling direction of the air is 25 mm×230 mm, which is the same as the size of the suction opening. Further, a size of a cross-section of a mounting portion of the fan 200*d* with respect to the air traveling direction is 60 mm×180 mm, and a size S2 of a cross-section of the collecting space 200*a*2 with respect to the air traveling direction is 60 mm×200 mm, which is larger than the size S1 of the cross-section of the charging space 200*a*1.

The sizes of the cross-sections in the exhaust duct 200*a* are summarized in Table 1 below. As the fan 200*d*, three 60 mm-square axial fans are used and arranged in parallel.

TABLE 1

| | Size of cross section |
|---|---|
| Suction opening | 25 mm × 230 mm (=0.00575 $m^2$) |
| Charging space 200a1 | 25 mm × 230 mm (=0.00575 $m^2$) |
| Mounting portion of fan 200d | 60 mm × 180 mm (=0.0108 $m^2$) |
| Collecting space 200a2 | 60 mm × 300 mm (=0.018 $m^2$) |

2) Charging Space 200*a*1

FIG. 4 is a perspective view of the charging means 200*b* provided in the charging space 200*a*1. In this embodiment, in the charging space 200*a*1, a first electrode (first electrode portion) 200*b*1 provided with a first potential and a second electrode 200*b*2 are provided opposed to each other as a pair. A plurality of pairs each consisting of the first electrode 200*b*1 and the second electrode 200*b*2 are provided along a direction crossing the flow path (part (b) of FIG. 3).

In FIG. 4, a metal plate provided with mountain-like projections which are equidistantly disposed is the first electrode 200*b*1, and a flat metal plate is the second electrode 200*b*2. These first and second electrodes 200*b*1 and 200*b*2 are disposed opposed to each other. Further, the first and second electrodes 200*b*1 and 200*b*2 are positioned by a case 200*b*3 formed of an insulating material. In this embodiment, the charging means 200*b* has a width W=12 mm, a height H=20 mm and a depth D=40 mm.

The first electrode 200*b*1 is formed of aluminum, stainless steel or the like in a thickness of 0.1 mm-1.0 mm, and a high voltage is applied thereto. The second electrode 200*b*2 is formed of aluminum, stainless steel or the like in a thickness of 0.1 mm-1.0 mm, and is grounded. In this embodiment, a 0.1 mm-thick stainless steel plate is used as the first electrode 200*b*1 and a 0.3 mm-thick aluminum plate was used as the second electrode 200*b*2. Further, the charging means 200*b* is disposed so that the first electrode 200*b*1 is parallel to the flow of the air in the charging space 200*a*1.

Here, a mechanism for electrically charging the UFPs will be specifically described. Between the first electrode 200*b*1 and the second electrode 200*b*2, a voltage from +1 kV to +20 kV or from −1 kV to −20 kV is applied (in this embodiment, a voltage of −3.2 kV was applied to the first electrode 200*b*1). As a result, a non-uniform electric field generates at a periphery of peaks of the mountain-like projections, so that continuous corona discharge generates. In the neighborhood of the electrode causing the corona discharge, electrons are attracted toward a side where a potential is high and are accelerated.

The electrons collide with molecules of the air, so that electrons are successively supplied from the collided molecules. The supplied electrons also increase in number thereof while repeating acceleration and collision, so that electron avalanche generates. When the air containing the UFPs is passed through this region, the UFPs can be electrically charged.

In the region (space) in which the electron avalanche generates, as many passing UFPs as possible are charged, and therefore in this embodiment, the charging means is disposed in parallel in the charging space 200*a*1.

In this embodiment, the size of the suction opening and the size S1 of the cross-section of the charging space 200*a*1 are the same, but is also possible to make the size S1 of the cross-section of the charging space 200*a*1 larger than the size of the suction opening. The reason therefor is that in order to charge the UFPs, passing of the UFPs through the region of the electron avalanche is a condition therefor and dependence of the UFPs passing through the region of the space is relatively small. By decreasing the size S1 of the cross-section of the charging space 200*a*1, the number of the charging means 200*b* arranged in parallel can be reduced and the charging space 200*a*1 can be disposed more freely.

3) Collecting Space 200*a*2

Using FIG. 3, the collecting space 200*a*2 will be described. As the collecting electrode 200*c* used as the second electrode portion which is provided in the second space and which provides a second potential different from the above-described first potential, a flat metal plate was used in this embodiment. The collecting electrode 200*c* is formed of aluminum, stainless steel or the like. In this embodiment, four 1.0 mm-thick aluminum plates each having a size of 25 mm×150 mm were arranged in the collecting space 200*c*1 so as to extend along and in parallel to the flow of the air. An arrangement direction of the collecting electrodes 200*c* is such that the collecting electrodes 200*c* are provided in the collecting space 200*a*2 so as to cross a direction of the flow of the air, and a direction in which the collecting electrodes 200*c* extend toward an upstream side with respect to the air flowing direction is set so as to form an angle of 45° or less between itself and the air flowing direction.

Here, the reason why the size S2 of the cross-section of the collecting space 200*a*2 shown in Table 1 is made larger than the size S1 of the cross-section of the charging space 200*a*1 will be specifically described. A Comparison Example principle of general electrostatic collection is such that the charged particles are moved to collecting electrode surfaces by an electrostatic force F(N) (F=qE) by an electric field E(N/C) formed between the collecting electrode and the particles charged to an electric charge q(C) and are collected at the collecting electrode surfaces.

In general, by the electrostatic collection, fine particles of 1 μm-20 μm in particle size can be collected with high efficiency, but there is a tendency that collecting efficiency for sub-micron particles of less than 1 μm in particle size lowers. As the reason therefor, it is possible to cite that a flowability of the particles to the air flow becomes high and movement of the particles by the electrostatic force becomes difficult. Particularly, most of the UFPs generated in the image forming apparatus are 0.1 μm or less in particle size, and therefore, it is not easy to achieve high collecting efficiency in normal electrostatic collection.

Therefore, in this embodiment, a constitution is employed in which a moving speed of the gas (air) is lowered in the collecting space, thus increasing the time for the UFPs to pass through the collecting space. The reason therefor will be described specifically. As shown in FIG. 5, gas (air) molecules always collide with the UFPs. The UFPs of 0.1 μm or less in particle size move and diffuse by the collision of the molecules. This is called Brownian diffusion motion. When the collecting electrodes are placed in the collecting space, the UFPs cause Brownian diffusion movement and approach the collecting electrodes. In the case where the UFPs are charged at this time, the electrostatic force acting on the UFPs becomes larger than a viscosity resistance of the gas (air) against the UFPs, so that the UFPs can be deposited on the collecting electrode surfaces.

As a result, on the collecting electrode surfaces, a concentration (density) of floating UFPs decreases, so that a concentration gradient generates in the neighborhood of the collecting electrodes. By this concentration gradient, the ambient UFPs diffuse in a collecting electrode direction and thus approach the collecting electrodes. By repeating this cycle, the UFPs can be collected with high efficiency. A movement space of this Brownian diffusion is relatively small (slow) (about 1 mm/sec), and therefore, there is a need to lower the UFP movement space and to increase the time for the UFPs to pass through the collecting space.

This embodiment is constituted in view of the above, and as a means for increasing the time for the UFPs to pass through the collecting space 200*a*2, by making the size S2 of the cross-section of the collecting space 200*a*2 larger than the size S1 of the cross-section of the charging space 200*a*1, the space of the charged UFPs is slowed.

In the following, size and air speeds (wind spaces) in this embodiment will be specifically described. The air speeds in the charging space 200*a*1 and the collecting space 200*a*2 in this embodiment were measured. The air speed causes a distribution in the space, and therefore, the air speed in this embodiment was an average air speed in the space. In order to check the average air speed in each of the charging space 200*a*1 and the collecting space 200*a*2, the air speed was measured so that all the air flow passes through an anemometer in the neighborhood of the charging means 200*b* and at the exhaust opening 200*e*.

The air speed was measured using a Vane anemometer ("Testo 410-2", manufactured by Testo Se & Co. KGaA). The volume of the air flowing in each of the charging space 200*a*1 and the collecting space 200*a*2 was calculated by multiplying the resultant air speed by a size of a cross-section of the anemometer. Then, the average air speed was acquired by dividing the resultant air volume by the size S1 of the cross-section of the charging space 200*a*1 or by the size S2 of the cross-section of the collecting space 200*a*2. The sizes of the cross-sections of the charging space 200*a*1 and the collecting space 200*a*2 and the average air speeds are summarized in Table 2. As shown in Table 2, in this embodiment, it was confirmed that the average air speed in the collecting space 200*a*2 is slower than the average air speed in the charging space 200*a*1 so as to be about 30% of the air speed in the charging space 200*a*1.

TABLE 2

| Space | Size of cross section | AAS*3 |
|---|---|---|
| CHS*1 200a1 | 25 mm × 230 mm (=0.0057 $m^2$) | 1.53 m/s |
| COS*2 200a2 | 60 mm × 300 mm (=0.018 $m^2$) | 0.48 m/s |

*1"CHS" is the charging space.
*2"COS" is the collecting space.
*3"AAS" is the average air speed.

(Confirmation of Effect)

A method of confirming an effect of this embodiment will be specifically described. The image forming apparatus 1 is placed in a chamber of 2 $m^3$ in volume, and images with a print ratio of 5% were continuously printed on the recording materials for 200 seconds. At that time, the concentration of the UFP in the chamber was measured using nano-particle size distribution measuring device ("FMPS 3019", manufactured by TSI Incorporated).

1) This Embodiment

This embodiment is based on the premise that the image forming apparatus has a structure of the exhaust duct 200*a* in which the size S1 of the cross-section of the charging space 200*a*1 with respect to the air traveling direction is 25 mm×230 mm and the size S2 of the cross-section of the collecting space 200*a*2 with respect to the air traveling direction is 50 mm×300 mm. An image forming operation was carried out under application of a voltage of −3.2 kV to the first electrode 200*b*1.

2) Comparison Example 1

In Comparison Example 1, the image forming apparatus having a structure of the exhaust duct 200*a*, in which the size S1 of the cross-section of the charging space 200*a*1 with respect to the air traveling direction is 25 mm×230 mm and the size S2 of the cross-section of the collecting space 200*a*2 with respect to the air traveling direction is 50 mm×300 mm, was used. In Comparison Example 1, different from the First Embodiment, an image forming operation was carried out with no application of the voltage.

3) Comparison Example 2

Comparison Example 2 is different from the First Embodiment in size of a cross-section of a collecting space with respect to the air traveling direction, and is the same as the First Embodiment except for this point. Part (a) of FIG. 6 is a longitudinal sectional view of a fixing device 10 and a UFP collecting means 201, and part (b) of FIG. 6 is a top view of the fixing device 10 and the UFP collecting means 201. In Comparison Example 2, the size S1 of the cross-section of the charging space 200*a*1 with respect to the air traveling direction is 25 mm×230 mm and the size S2 of the cross-section of a collecting space 201*a*2 with respect to the air traveling direction is also 25 mm×230 mm, which is the same as the size S1 of the charging space 200*a*1.

By using an image forming apparatus including an exhaust duct 201*a* having the above-described structure, the image forming operation was carried out under application of the voltage of −3.2 kV to the first electrode 200*b*1 similarly as in the First Embodiment. Incidentally, the average air speed of the air passing through the charging space 200*a*1 in Comparison Example 2 is equal to the average air speed of the air passing through the charging space 200*a*1 in the First Embodiment.

Measurement results for the above-described image forming apparatuses are shown in FIG. 7. In FIG. 7, the abscissa represents time(s), and the ordinate represents the number of the UFPs per 1 $cm^3$ (UFP concentration) (particles/$cm^3$). Further, parameters and results relating to Comparison Example 1, Comparison Example 2 and the First Embodiment (this embodiment) are shown in Table 3. When Comparison Example 1 and Comparison Example 2 are compared with each other, in Comparison Example 2, 45% of the UFPs were able to be collected as compared with that in Comparison Example 1 by providing the electrostatic collecting means. Further, when Comparison Example 2 and the First Embodiment (this embodiment) are compared with each other, the UFP Comparison Example efficiency was able to be further enhanced by making the air speed in the collecting space in the First Embodiment slower than that in Comparison Example 2 so as to be about 30% of the air speed in the collecting space in Comparison Example 2.

As described above, by employing a constitution in which the size of the cross-section of the collecting space is made larger than the size of the cross-section of the charging space, the UFPs are capable of being collected efficiently.

TABLE 3

| | CHARGING SPACE | | | COLLECTING SPACE | | UFP COLECTING EFFICIENCY |
|---|---|---|---|---|---|---|
| EMB OR COMP. EX | VOLTAGE | SIZE OF CROSS SECTION | AVERAGE AIR SPEED | SIZE OF CROSS SECTION | AVERAGE AIR SPEED | COMPARED WITH COMP. EX. 1 |
| COMP. EX. 1 | 0 kV | 25 mm × 230 mm (0.00575 $m^2$) | 1.53 m/s | 60 mm × 300 mm (0.018 $m^2$) | 0.48 m/s | — |
| COMP. EX. 2 | −3.2 kV | 25 mm × 230 mm (0.00575 $m^2$) | 1.53 m/s | 25 mm × 230 mm (0.00575 $m^2$) | 1.53 m/s | 45% |
| EMB. 1 | −3.2 kV | 25 mm × 230 mm (0.00575 $m^2$) | 1.53 m/s | 60 mm × 300 mm (0.018 $m^2$) | 0.48 m/s | 80% |

Incidentally, in this embodiment, as the first electrode 200*b*1 of the charging means, the metal plate provided with the mountain-like projections which are equidistantly disposed is used, but a metal wire may also be used.

Further, in this embodiment, the collecting electrode 200*c* as the second electrode portion is connected to the ground (i.e., is grounded and a potential thereof is zero), but a voltage of a polarity opposite to the polarity of the voltage applied to the charging means may also be applied to the collecting electrode 200*c*. That is, the potential of the collecting electrode 200*c* as the second electrode portion may also be opposite in polarity to the potential of the first electrode 200*b*1 of the first and second electrodes 200*b*2 and 200*b*2 constituting the first electrode portion.

Further, the potential of the collecting electrode 200*c* as the second electrode portion may also be the same in polarity as the potential of the first electrode 200*b*1 of the first and second electrodes 200*b*1 and 200*b*2 constituting the first electrode portion and may also be a value closer to zero.

Further, in this embodiment, the exhaust duct 200*a* is entirely formed of the resin material, but a part of a wall constituting the collecting space 200*a*2 is formed with a metal component part connected to the ground (grounded). By forming the wall of the collecting space 200*a*2 with the metal component part, the metal wall can also be used as the collecting electrode, so that a surface area of the collecting electrode can be increased. When the surface area of the collecting electrode is increased, a possibility that the charged UFPs approach the collecting electrode becomes high, so that the collecting efficiency can be enhanced.

Further, in this embodiment, the collecting electrode 200*c* has the flat plate shape, but may also be provided with projections or a bent portion. When the collecting electrode is provided with the projections or the bent portion, the surface area of the collecting electrode can be increased, so that the collecting efficiency can be enhanced for the same reason described above.

Second Embodiment

A Second Embodiment is different from the First Embodiment in constitution of the collecting space and is the same as the First Embodiment except for this point. Part (a) of FIG. 8 is a longitudinal sectional view of a fixing device 10 and a UFP collecting means 202 in this embodiment in which a branched collecting space is provided, and part (b) of FIG. 8 is a top view of the fixing device 10 and the UFP collecting means 202. In this embodiment, the collecting space 202*a*2 is branched into a first collecting space 202*a*21 and a second collecting space 202*a*22, and the collecting electrode 200*c* is disposed in each of the first and second collecting spaces 202*a*21 and 202*a*22.

The reason why the collecting space 202*a*2 is branched into the first collecting space 202*a*21 and the second collecting space 202*a*22 is that by branching the collecting space into two collecting spaces, even an image forming apparatus in which it is difficult to provide a collecting space having a large cross-section can be installed.

When the fan 200*d* is rotated, the UFPs generated in the fixing device 10 pass through the opening 109 and are guided through the suction opening in arrow directions in the exhaust duct 202*a*. The air containing the guided UFPs passes through the charging space 200*a*1 and thereafter passes through the first collecting space 202*a*21 and the second collecting space 202*a*22, so that the UFPs are collected, and the air passes through the exhaust opening 200*e* and is discharged to the outside of the image forming apparatus.

The size of the cross-section of the collecting space 202*a*2 with respect to the air traveling direction is represented by a sum of a size S4 of the cross-section of the first collecting space 202*a*21 and a size S5 of the cross-section of the second collecting space 202*a*22 with respect to the air traveling direction. In this embodiment, the size of the cross-section of the collecting space 202*a*2 was made larger than the size S1 of the cross-section of the charging space 200*a*1 (i.e., S4+S5>S1). As a result, the speed of the UFPs passing through the collecting space 202*a*2 becomes slow, so that an effect similar to that in the First Embodiment can be obtained.

Incidentally, the size S4 of the cross-section of the first collecting space 202*a*21 and the size S5 of the cross-section of the second collecting space 202*a*22 may also be not equal to each other.

Further, in this embodiment, a constitution in which the collecting space 202*a*2 is branched into the two collecting spaces, i.e., the first collecting space 202*a*21 and the second collecting space 202*a*22, is employed, but the number of branched collecting spaces may also be three or more.

Third Embodiment

The Third Embodiment is different from the First Embodiment with respect to a space (electrical space) in which an electronic circuit board (substrate) in an image forming apparatus is provided and is the same as the First Embodiment except for this point. FIG. 9 is a longitudinal sectional view of an image forming apparatus 14 in this embodiment, and an electrical space 15 in which the electronic circuit board is disposed is provided in a space in the neighborhood of the laser beam scanner 4 on a side opposite from a side where the laser light L travels. Incidentally, the constitution of the image forming apparatus 14 and the constitution of the fixing device 10 in this embodiment are same as those in the First Embodiment and will be omitted from description.

Part (a) of FIG. 10 is a longitudinal sectional view of a fixing device 10 and a UFP collecting means 203 in this embodiment, and part (b) of FIG. 10 is a top view of the fixing device 10 and the UFP collecting means 203. A collecting space 203*a*2 is the electronic space 15, and as a collecting electrode 203*c*, the electronic circuit board disposed in the electrical space 15 is used. The electronic circuit board and electronic component parts mounted thereon are supplied with a voltage or grounded, and therefore the charged UFPs can be collected.

In this embodiment, the reason why the already-existing electrical space 15 is used as the collecting space 203*a*2 in the image forming apparatus 14 is that there is no need to particularly provide the collecting space of the UFP collecting means, and therefore, installation of the UFP collecting means becomes easy. In the case where a temperature of the air flowing into the electrical space 15 is lower than a desired temperature, it is also possible to cool the electronic component parts mounted on the electronic circuit board.

When the fan 200*d* is rotated, the UFPs generated in the fixing device 10 are guided through the suction lattice-like opening 109 in arrow directions in the exhaust duct 203*a*. The air containing the guided UFPs passes through the charging space 200*a*1 and thereafter passes through the collecting space 203*a*2, so that the UFPs are collected, and the air passes through the exhaust opening 200*e* and is discharged to the outside of the image forming apparatus.

As the air traveling direction in the collecting space 203*a*3, a direction of a comprehensive air flow (arrow C direction shown in part (a) of FIG. 10) traveling from the inlet opening to a vent 200*e* was assumed. Accordingly, a cross-section S6 of the collecting space 203*a*2 with respect to the air traveling direction is a cross-section with respect to the arrow C direction. In this embodiment, the size S6 of the cross-section of the collecting space 203*a*2 was made larger than the size S1 of the cross-section of the charging space 200*a*1. As a result, the speed of the UFPs passing through the collecting space 203*a*2 becomes slow, so that an effect similar to that in the First Embodiment can be obtained.

Modified Embodiments

In the above, preferred embodiments of the present invention were described. However, the present invention is not limited to these embodiments, but can be variously modified and changed within the scope of the present invention.

Modified Embodiment 1

In the above-described embodiments, the constitution in which the image forming apparatus is provided with the UFP collecting means 200 was described, but a constitution in which the fixing device is provided with the UFP collecting means 200 may also be employed.

In the above-described embodiments, heating in the fixing device was made by the heater, but the present invention is not limited thereto and may also use an electromagnetic induction heating type using an exciting coil. In this case, when a back-up member is provided in place of the heater, it is possible to form a nip in a pressed state.

Modified Embodiment 2

In the above-described embodiments, as the recording material, the recording paper was described, but the recording material in the present invention is not limited to the paper. In general, the recording material is a sheet-like member on which the toner image is formed by the image forming apparatus and includes, for example, regular or irregular materials, such as plain paper, thick paper, thin paper, an envelope, a postcard, a seal, a resin sheet, an OHP sheet, and glossy paper. In the above-described embodiments, for convenience, handling of the recording material (sheet) P was described using terms such as the sheet feeding and the sheet discharge, but by these terms, the recording material in the present invention is not limited to the paper.

Modified Embodiment 3

In the above-described embodiments, the fixing device for fixing the unfixed toner image on the sheet was described as an example, but the present invention is not limited thereto. The present invention is also similarly applicable to a device for heating and pressing a toner image temporarily fixed on the sheet in order to improve a gloss (glossiness) of an image (also in this case, the device is referred to as the fixing device).

While the present invention has been described with reference to exemplary embodiments, is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-001605 filed on Jan. 10, 2018, which is hereby incorporated by reference herein in its entirety.

What is claimed is:

1. An image forming apparatus comprising:

an image forming portion configured to form a toner image on a recording material;

a fixing portion configured to fix the toner image on the recording material by heating the toner image formed on the recording material;

a flow path, including a first space connecting with said fixing portion and a second space connecting with said first space, through which air discharged from said fixing portion passes;

a first electrode portion provided in said first space and provided with a first potential; and a second electrode portion provided in said second space and provided with a second potential different from the first potential, wherein said first electrode portion is configured to electrically charge fine particles contained in the air in said first space, wherein said first electrode portion is provided as a pair of electrodes opposing each other with respect to a direction crossing an air passing direction, wherein an air speed of the air passing through said second space is slower than an air speed of the air passing through said first space, and wherein the fine particles are collected by said second electrode portion in said second space.

2. An image forming apparatus according to claim 1, wherein said second electrode portion is grounded, and the second potential is zero.

3. An image forming apparatus according to claim 1, wherein the second potential is opposite in polarity to the first potential.

4. An image forming apparatus according to claim 1, wherein the pair of electrodes is provided in plurality.

5. An image forming apparatus according to claim 1, wherein said second space is branched into a plurality of spaces, and said second electrode portion is provided in each of the branched spaces.

6. An image forming apparatus according to claim 1, wherein said second electrode portion is constituted by a metal wall defining said second space.

7. An image forming apparatus according to claim 1, wherein said second electrode portion includes an electrode provided with a projection or a bent portion so as to increase a surface area thereof.

8. An image forming apparatus according to claim 1, further comprising a flow path forming portion provided along a direction crossing a feeding direction of the recording material in said fixing portion.

9. An image forming apparatus comprising:

an image forming portion configured to form a toner image on a recording material;

a fixing portion configured to fix the toner image on the recording material by heating the toner image formed on the recording material;

a flow path, including a first space connecting with said fixing portion and a second space connecting with said first space, through which air discharged from said fixing portion passes;

a first electrode portion provided in said first space and provided with a first potential; and a second electrode portion provided in said second space and provided with a second potential different from the first potential, wherein said first electrode portion is configured to electrically charge fine particles contained in the air in said first space, wherein said first electrode is provided as a pair of electrodes opposing each other with respect to a direction crossing an air passing direction, wherein a cross-sectional area of said second space with respect to a direction perpendicular to a direction of the air entering said second space is larger than a cross-sectional area of said first space with respect to a direction perpendicular to a direction of the air entering said first space, and wherein the fine particles are collected by said second electrode portion in said second space.

10. An image forming apparatus according to claim 9, further comprising a flow path forming portion provided with a suction opening open toward said first space, wherein a size of a cross-section through which the air passes is larger in said first space than said suction opening.

11. An image forming apparatus according to claim 9, further comprising a flow path forming portion provided with respect to a feeding direction of the recording material in said fixing portion.

12. An image forming apparatus according to claim 9, wherein said second electrode portion is grounded, and the second potential is zero.

13. An image forming apparatus according to claim 9, wherein the second potential is opposite in polarity to the first potential.

14. An image forming apparatus according to claim 9, wherein the pair of electrodes is provided in plurality.

15. An image forming apparatus comprising:

an image forming portion configured to form a toner image on a recording material;

a fixing portion configured to fix the toner image on the recording material by heating the toner image formed on the recording material;

a flow path, including a first space connecting with said fixing portion and a second space connecting with said first space, through which air discharged from said fixing portion passes;

a first electrode portion provided in said first space and provided with a first potential; and a second electrode portion provided in said second space and provided with a second potential different from the first potential, wherein said first electrode portion is configured to electrically charge fine particles contained in the air in said first space, wherein an air speed of the air passing through said second space is slower than an air speed of the air passing through said first space, wherein said second electrode portion is grounded, and the second potential is zero, and wherein the fine particles are collected by said second electrode portion in said second space.

16. An image forming apparatus according to claim 15, wherein said second space is branched into a plurality of spaces, and said second electrode portion is provided in each of the branched spaces.

17. An image forming apparatus according to claim 15, wherein said second electrode portion is constituted by a metal wall defining said second space.

18. An image forming apparatus according to claim 15, wherein said second electrode portion includes an electrode provided with a projection or a bent portion so as to increase a surface area thereof.

19. An image forming apparatus according to claim 15, further comprising a flow path forming portion provided along a direction crossing a feeding direction of the recording material in said fixing portion.

20. An image forming apparatus comprising:

an image forming portion configured to form a toner image on a recording material;

a fixing portion configured to fix the toner image on the recording material by heating the toner image formed on the recording material;

a flow path, including a first space connecting with said fixing portion and a second space connecting with said first space, through which air discharged from said fixing portion passes;

a first electrode portion provided in said first space and provided with a first potential; and a second electrode portion provided in said second space and provided with a second potential different from the first potential, wherein said first electrode portion is configured to electrically charge fine particles contained in the air in said first space, wherein a cross-sectional area of said second space with respect to a direction perpendicular to a direction of the air entering said second space is larger than a cross-sectional area of said first space with respect to a direction perpendicular to a direction of the air entering said first space, wherein said second electrode portion is grounded, and the second potential is zero, and wherein the fine particles are collected by said second electrode portion in said second space.

21. An image forming apparatus according to claim 20, further comprising a flow path forming portion provided with a suction opening open toward said first space, wherein a size of a cross-section through which the air passes is larger in said first space than said suction opening.

22. An image forming apparatus according to claim 20, further comprising a flow path forming portion provided with respect to a feeding direction of the recording material in said fixing portion.

23. An image forming apparatus according to claim 1, wherein said first electrode portion is arranged along a direction from upstream of said flow path to downstream of said flow path.

24. An image forming apparatus according to claim 9, wherein said first electrode portion is arranged along a direction from upstream of said flow path to downstream of said flow path.

* * * * *